United States Patent [19]

Turner et al.

[11] 4,354,633

[45] Oct. 19, 1982

[54] MANUAL MAIN SHUTOFF VALVE FOR A GAS BURNER COMBINATION CONTROL

[75] Inventors: Jesse H. Turner, Auburn; Elmer E. Wallace, Fort Wayne, both of Ind.

[73] Assignee: Essex Group, Inc., Fort Wayne, Ind.

[21] Appl. No.: 290,920

[22] Filed: Aug. 7, 1981

[51] Int. Cl.[3] ..... G05D 73/12

[52] U.S. Cl. ..... 236/1 H; 236/99 G; 251/229

[58] Field of Search ..... 236/1 H, 26 A, 15 A, 236/99 G; 251/263, 245, 246, 229

[56] References Cited

U.S. PATENT DOCUMENTS

| | | | |
|---|---|---|---|
| 1,718,730 | 6/1929 | Brown | 251/263 X |
| 2,271,183 | 1/1942 | De Lancey | 251/229 |
| 2,387,793 | 10/1945 | Holmes | 236/99 G |
| 3,080,144 | 3/1963 | Baker | 251/245 X |
| 3,170,485 | 2/1965 | Ages | 236/1 H X |
| 3,454,222 | 7/1969 | Willson | 236/99 G |
| 3,559,884 | 2/1971 | Visos et al. | 236/15 A X |
| 3,681,586 | 1/1975 | Katchka | 236/1 |
| 3,685,730 | 8/1972 | Katchka | 236/21 |
| 3,861,587 | 1/1975 | Katchka | 236/1 |

FOREIGN PATENT DOCUMENTS

| | | | |
|---|---|---|---|
| 1050785 | 2/1952 | France | 251/263 |

*Primary Examiner*—William E. Tapolcai
*Attorney, Agent, or Firm*—Robert D. Sommer

[57] ABSTRACT

A manual main shutoff valve for a gas burner combination control of the type having a casing which includes a housing plate in overlying relation to a partition plate. An axially movable valve member is spring biased to a closed position seated on a valve seat portion of the partition plate. A rotary valve actuator carried by the housing plate includes a cam member in engagement with the cam follower of an operating lever which is pivotally mounted in the casing and operatively connected to the valve member for moving the valve member to an open position in response to rotation of the valve actuator to an "ON" position.

3 Claims, 7 Drawing Figures

FIG. 4
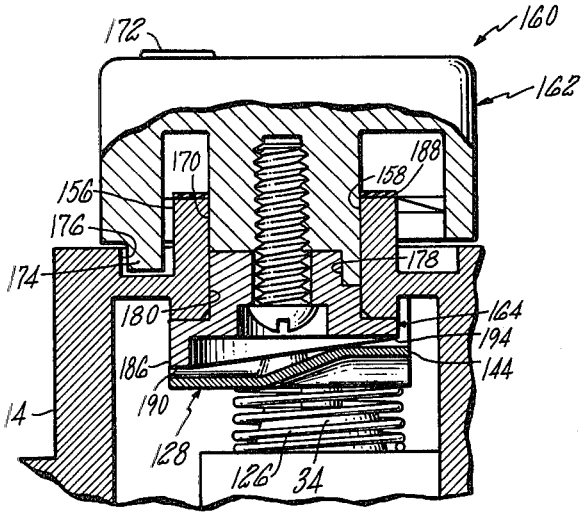
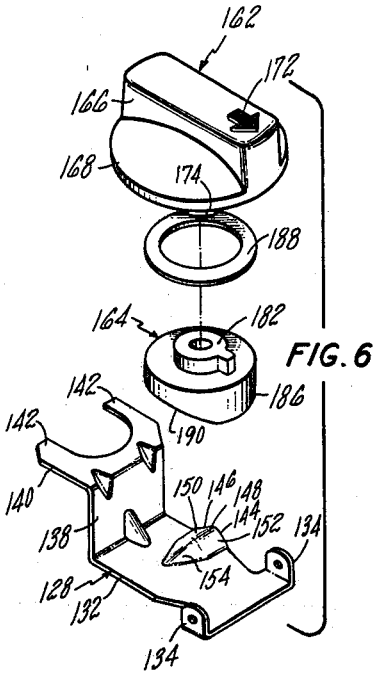
FIG. 6
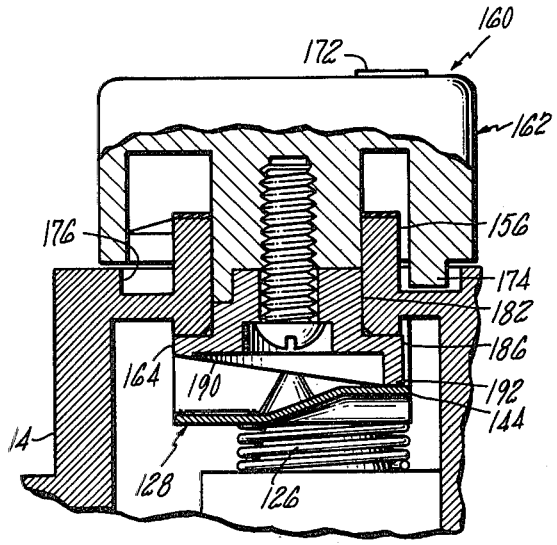
FIG. 5
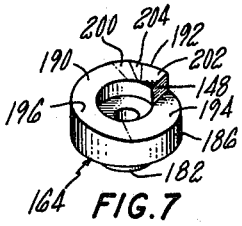
FIG. 7

MANUAL MAIN SHUTOFF VALVE FOR A GAS BURNER COMBINATION CONTROL

BACKGROUND OF THE INVENTION

This invention relates to a combination control for gas burners of a type having a plurality of control valves including a manual main shutoff valve, a thermostatic valve and a diaphragm valve. More particularly, the invention relates to a manual main shutoff valve for a combination control of the above-mentioned type wherein an axially movable valve member is operated by a rotatable valve actuator.

Conventional combination controls for gas burners utilize a plug valve as a manual main shutoff valve to interrupt all gas flow such as when complete shutdown of a gas burner is desired. The plugs and bores in the control casings receiving the plugs are tapered and require costly accurate fitting of the plugs in the casings of combination controls to prevent leakage. Although, a spring may be employed to urge the tapered plug to the small end of the tapered bore receiving the plug, plug valves tend to leak when accidentally subjected to high gas pressures and the plug may even pop out of the bore. High temperature conditions tend to cause the plug to seize in the bore.

To avoid the disadvantages of the plug valve, combination controls have been devised with manually operated means which prevent opening of the thermostatic valve when complete shutoff of gas flow is desired. Combination controls of this type are disclosed in the three Katchka U.S. Pat. Nos. 3,685,730, 3,861,586 and 3,861,587. In these combination controls, a pivotally mounted lever operated by cam means on a rotary actuator forces the thermostatic valve member against its seat regardless of whether or not a thermostatic operator is acting to open the thermostatic valve. The safety valve of each of these controls is also closed at the same time the thermostatic valve is manually closed. The manual shutoff valve arrangements of the aforesaid Katchka patents are not adaptable to the commonly used combination controls of the diaphragm valve type having an electromagnetically operated thermostatic valve which is opened to supply fuel to a pilot burner each time a space thermostat closes in demand for burner operation. Furthermore, this type of combination control does not have a manually main shutoff valve which can interrrupt gas flow to the thermostatic valve.

SUMMARY OF THE INVENTION

The present invention provides an improved manual main shutoff valve construction for combination controls of low manufacturing cost and reliable operation even under adverse pressure or temperature conditions. A valve operating stem axially movable within the casing of the combination control is connected at one end to a valve member. A spring acting on the opposite end of the stem biases the valve member to a closed position seated on a valve seat portion of a casing partition plate. A valve actuator rotatably carried on a housing plate of the casing for manual rotation between off and on positions includes a cam member in engagement with the cam follower of an operating lever. The operating lever is pivotally mounted in the casing and is operatively connected to the valve operating stem. The cam surface of the cam member includes a raised portion engaging the cam follower in the on position of the actuator and a lower portion engaging the cam follower in the off position of the actuator. The raised and lower portions of the cam surface are connected by an inclined portion engaging the cam follower during rotation of the actuator between its off and on positions. Rotation of the actuator provides pivoting motion of the operating lever for operating the valve member.

In accordance with a preferred embodiment of the invention, the valve operating stem is slidably mounted in a wall portion of the partition plate spaced from the valve seat portion thereof. The spring acting on the stem encircles the stem and is compressed between the wall portion and a generally cup-shaped retainer fixed to the aforesaid opposite end of the stem. The operating end of the lever is bifurcated to straddle a sleeve portion of the retainer and to engage a flange on the retainer for moving the valve member to its open position.

Also, in accordance with a preferred embodiment of the invention, the valve actuator carries an abutment member engageable with spaced stops on the housing plate to limit rotational movement of the actuator between its off and on positions. The raised portion of the cam surface includes a drop-off section engageable with the cam follower of the lever when the abutment member engages a stop in the on position of the actuator for releasably holding the actuator in its on position.

For a better understanding of the invention, reference may be had to the following detailed description taken in connection with the accompanying drawings, in which:

BRIEF DESCRIPTION OF THE DRAWINGS

FIG. 4 is a fragmentary sectional view taken substantially along the line 4—4 of FIG. 1;

FIG. 5 is a fragmentary sectional view similar to FIG. 5 and illustrating various parts in a different operating position than the operating position shown in FIG. 4;

FIG. 6 is an exploded perspective view of the knob, spring washer, cam, and operating lever of the manual main shutoff valve;

and

FIG. 7 is another perspective view of the cam of the manual main shutoff valve.

DESCRIPTION OF THE PREFERRED EMBODIMENT

Figure 1:
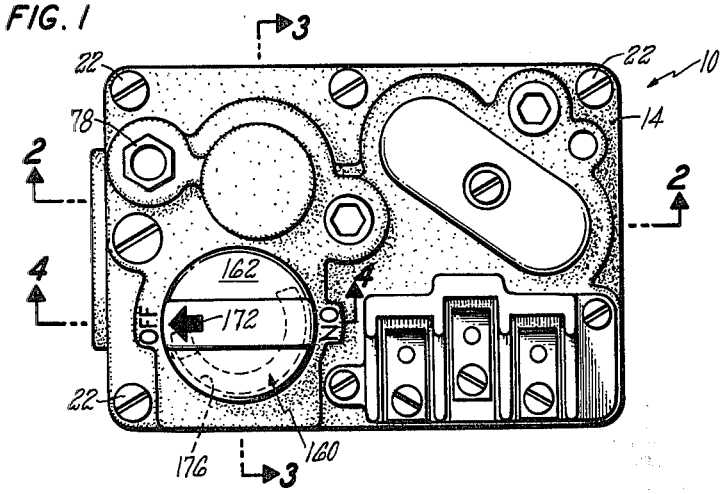
FIG. 1 is a top plan view of a combination control with a manual main shutoff valve embodying the invention.
Figure 2:
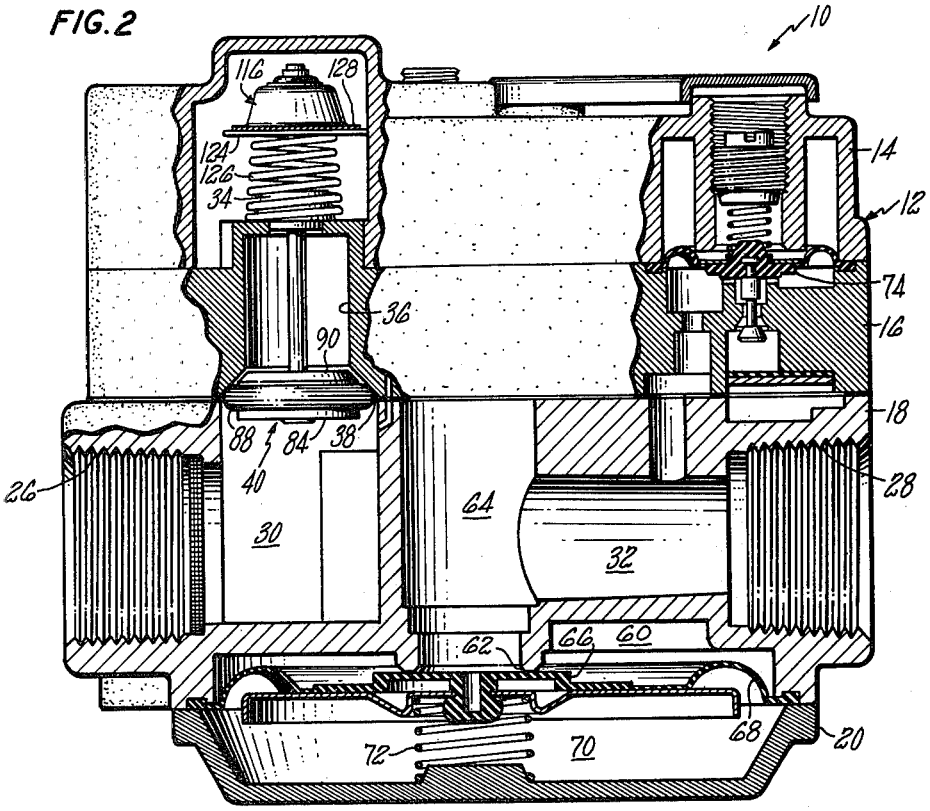
FIG. 2 is a sectional view taken substantially along the line 2—2 of FIG. 1.
Figure 3:
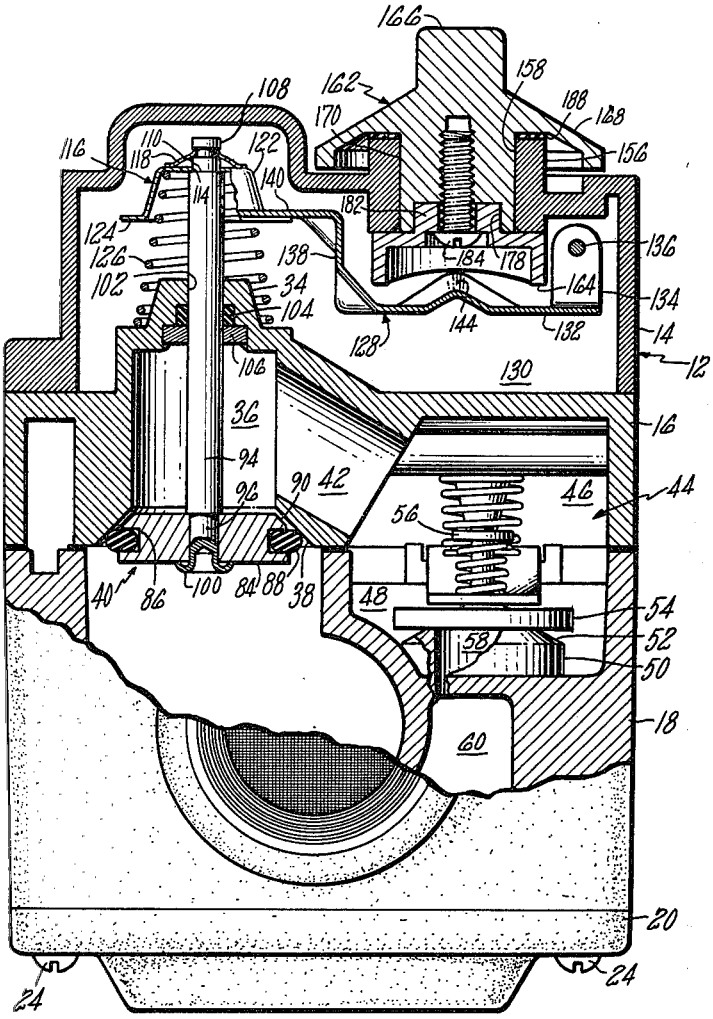
FIG. 3 is a sectional view taken substantially along the line 3—3 of FIG. 1.

Referring now to FIGS. 1-3 of the drawings, a combination control 10 for a gas burner is shown as having a hollowed casing 12 which includes an upper housing plate 14, an intermediate partition plate 16, a main body 18 and a lower cover plate 20. The plates 14, 16 and the main body 18 are secured together in suitably sealed relation by the screws 22 and the plate 20 is secured to the main body 18 in a suitably sealed relation by the screws 24.

The main body 18 is provided with a threaded inlet 26 and a threaded outlet 28 which communicate respectively with an inlet chamber 30 and an outlet chamber 32. Extending downwardly within the partition plate 16 from a hollow boss 34 is a bore 36 which terminates in an annular valve seat 38 open to the inlet chamber 30. The valve member 40 of a manual main shutoff valve to be subsequently described in detail is resiliently biased to a closed position seated on the valve seat 38. As shown in FIG. 3, a port 42 extends through the partition plate 16 from the bore 36 to a thermostatic valve chamber 44 defined by cavities 46 and 48 respectively formed in the plate 16 and the body 18. The body 18 has a hollow upstanding boss 50 located in the cavity 48 with its upper end shaped to provide a valve seat 52 for a downwardly closing and upwardly opening valve member 54 of a thermostatic valve 56 which is mounted upon the body 18 within the chamber 44.

The bore 58 of the boss 50 is in communication with a cavity 60 formed in the lower side of the main body 18. As shown in FIG. 2, the body 18 also has a valve seat 62 at the lower end of a bore 64 which is in communication with the outlet chamber 32. A diaphragm type valve member 66 cooperates with the valve seat 62 to control gas flow to the outlet 28 and to regulate the pressure of the gas flow. The valve member 66 is an integral part of a flexible diaphragm 68 which has its periphery clamped between the adjoining surfaces of the body 18 and the cover plate 20. The cover plate 20 is recessed to define an operating pressure chamber 70 that is separated from the cavity 60 by the diaphragm 68. The valve member 66 is normally biased toward the valve seat 62 by a coil spring 72.

The diaphragm 68 is operated by the differential gas pressure between the cavity 60 and the operating pressure chamber 70. The gas pressure in the chamber 70 is controlled by a bleed flow system (not fully shown) which has a main portion extending from the cavity 60 to the outlet chamber 32 and an intermediate portion communicating with the chamber 70. The bleed flow system may be of a form similar to that illustrated in the Hirst U.S. Pat. No. 4,009,861 with a main portion in which are serially connected a restriction orifice (not shown), an electromagnetically operated bleed valve (not shown) and a servo regulator 74 (FIG. 2). As is well known, the bleed flow system may also include a second servo regulator (not shown) and a step valve (not shown) for for operation of the diaphragm valve member 66 with stepped opening characteristics.

From the foregoing description, it will be seen that the inlet chamber 30, bore 36, port 42, chamber 44, bore 58, cavity 60, bore 64 and the outlet chamber 32 provide a main gas flow passage disposed between the inlet 26 and the outlet 28. The valve members 40, 54 and 66 are serially connected in this flow passage and all three valve members must be opened to permit gas flow from the inlet 26 to the outlet 28. The combination control 10 further includes a pilot outlet tubing connector 78 communicating with the cavity 60 through pilot passages (not shown) and a filter in a cavity (not shown) formed in the partition plate 16. The valve members 40 and 54 thus must be opened to permit gas flow from the inlet 26 to the pilot outlet tubing connector 78.

The aforesaid structure is generally similar to combination controls of conventional manufacture which, however, employ a rotary plug or disc valve as a manual main shutoff valve instead of the valve member 40. In the improved manual main shutoff valve of the present invention, the valve member 40 comprises a generally cylindrical disc 84 which is provided with a peripheral groove 86 in which an O-ring 88 of silicone rubber is inserted. An upper peripheral flange 90 of the disc 84 is of a frustro-conical shape corresponding to the beveled annular valve seat 38 to permit seating of the O-ring 88 against the valve seat 38 in the closed position of the valve member 40. A valve operating stem 94 has a reduced diameter end portion 96 which extends through a central bore 98 in the disc 84 and has its lower end 100 peened against the disc 84 to secure the latter to the stem 94. The stem 94 extends upwardly through an opening 102 in the boss 34 of partition plate 16 with a gas tight seal provided by an O-ring 104 which is retained in the boss 34 by a washer 106. The O-ring 104 may be libricated with a suitable silicone grease for free axial movement of the stem 94 through the boss 34.

At its upper end, the stem 94 has a shank 108 of reduced diameter and an annular shoulder 110. The shank 108 extends through a central opening in the radial end wall 114 of a generally cup-shaped spring retainer 116. The retainer is secured on the stem 94 against the shoulder 110 by a retaining ring 118 that is seated in an annular groove formed in the shank 108. A sleeve 122 of frustro-conical shape extends downwardly from the end wall 114 of the retainer 116 and terminates at its open end in an outwardly directed annular flange 124. A coiled spring 126 encircles the stem 94 with one end surrounding the boss 34 and the other end received in the retainer 116. As the spring 126 is compressed between the partition plate 16 and the retainer end wall 114, the force of the spring 126 acts upon the stem 94 to normally bias the valve member 40 against the valve seat 38.

The improved manual main shutoff valve of the present invention also includes an operating lever 128 pivotally mounted within a cavity 130 formed in the lower side of the housing plate 14. The operating lever 128 comprises a main plate section 132 having two parallel tabs 134 at one end extending upwardly from each side thereof. The tabs 134 at one end extending upwardly from each side thereof. The tabs 134 are apertured to receive a pivot pin 136 which is supported in the housing plate 14. At the other end of the plate section 132 is an upright arm section 138 which is joined at its uper end to an outwardly directed operating end section 140 that extends substantially parallel to the plate section 132. The operating end section 140 is bifurcated to provide a pair of prongs 142 which straddle the sleeve 122 of the spring retainer 116 for abutting engagement with the flange 124 thereof. A cam follower 144 is pressed out of the plate section 132 adjacent one edge thereof to provide an upper cam follower surface 146 comprising an apex 148 and two oppositely slanting surfaces 150, 152. The cam follower 144 may include a unitarily formed lateral extension 154.

Immediately above the plate section 132 of the operating lever 128, the housing plate 14 is provided with a generally cylindrical collar 156 through which extends a bore 158 open to the cavity 130. A valve actuator assembly 160 comprising a knob 162 and a cam member 164 are rotatably carried on the collar 156. The knob 162 has a handle portion 166 with a skirt 168 formed therewith as well as a cylindrical hub 170 on the back side thereof that is rotatably received in the bore 158. As illustrated in FIG. 1, a pointer 172 on the handle portion 166 indicates the location of the knob 162 relative to "OFF" and "ON" indicia provided on the top surface of the housing plate 14. Projecting downwardly from the skirt 168 is a lug or an abutment member 174 which extends into an arcuate track or groove 176 formed in the top surface of the housing plate 14. The opposite ends of the groove 174 serve as stops adapted to be engaged by the abutment member 172 for limiting rotation of the knob 162 between "OFF" and "ON" positions.

The hub 170 of the knob 162 is provided with a cylindrical bore 178 and a radial slot 180 for keyed reception therein of the stem portion 182 of the cam member 164. The cam member 164 is secured to the knob 162 by a screw 184 threaded into the hub 170. A cam disc portion 186 joined to the stem portion 182 of the cam member 164 has its upper surface resiliently urged against the lower end of the collar 156 by a ring spring 188 that is disposed between the knob 162 and the upper end of the collar 156. A cam surface 190 is provided on the under side of the cam disc portion 186 for engagement with the cam follower 144 of the operating lever 128. The cam surface 190 includes a raised portion 192 and a lower portion 194 connected by an inclined portion 196. At the other end of the raised portion 192, the cam member 164 may have a wall 198 which is substantially perpendicular to the raised portion 192 and which extends to the lower portion 194. The inclined portion 196 extends through a radial angle of about 164° and the raised portion 192 extends through a radial angle of about 60°. Adjacent the inclined portion 196, the raised portion 192 of the cam surface 190 has a first planar section 200 which is elevated about 0.25 mm above a second planar section 202 and which is joined to the latter section by a drop-off section 204. The planar section 200 extends through a radial angle of about 16° and the drop-off section 204 extends through a radial angle of about 8°. The inclined portion 196 and the sections 200 and 204 of the raised portion 192 each preferably begin and terminate along lines oriented at about 14° from radial positions.

It will be observed that the respective components of the manual main shutoff valve are conveniently assembled on the housing plate 14 and the partition plate 16 prior to final assembly of these plates to the main body 18. After the valve operating stem 94 with its disc 84 and O-ring 88 is mounted in the partition place 16 and the spring 126 and the retainer 116 are secured in place with the retaining ring 118, the partition plate 16 is placed upon the main body 18. The subassembly of the housing plate 14 with the attached operating lever 128 and the valve actuator assembly 160 is then placed upon the partition plate 16 and the plates 14 and 16 are fastened to the main body 18 with the screws 22.

In the operation of the improved manual main shutoff valve, the cam follower 144 of the operating lever 128 rides upon the cam surface 190 of the cam member 164 to effect pivotal movement of the operating lever 128 about the pivot pin 136 upon rotation of the knob 162 between its "OFF" and "ON" positions. When the knob 162 is in its "OFF" position shown in FIGS. 1–4, the cam follower 144 is in engagement with the lower portion 194 of the cam surface 190 adjacent the inclined portion 196 and the operating lever 128 assumes the position shown in FIG. 3. In this position, the prongs 142 of the operating lever 128 are elevated sufficiently to permit the spring 126 to force the valve stem 94 upwardly so as to bias the valve member 40 to a closed position on the valve seat 38.

When the knob 162 is rotated to its "ON" position shown in FIG. 5, the cam follower 14 rides up the inclined portion 196 of the cam surface 190 onto the raised portion 192 as illustrated in FIG. 5. This engagement of the cam surface 190 with the cam follower 144 pivots the operating lever 128 about the pivot pin 136 in a downward direction to cause the prongs 142 to force the spring retainer 116 downwardly against the force of the spring 126. The downward movement of the retainer 116 moves the valve member 40 from the valve seat 38 to an open position. As the abutment member 174 on the knob 162 approaches the end of the groove 74 in plate 14, the cam follower 144 rides on the raised portion 192 of the cam surface 190 from the first section 200 over the drop-off section 204 to the second section 202. The drop-off section 204 accordingly acts to releasably hold the knob 162 in its "ON" position. Unless the knob 162 is rotated sufficiently to permit the drop-off section 204 to pass over the cam follower 144, the operating lever 128 will tend to be returned to its elevated position by the spring 126. The drop-off section 204 thus ensures against accidental movement of the valve member 40 to a closed position.

Counter rotation of the knob 162 from its "ON" position moves the cam surface 190 back over the cam follower 144. After the cam follower 144 rides over the drop-off section 204 onto the inclined portion 196, the action of the spring 126 on the operating lever 128 provides a cooperating force in return of the valve member 40 to its closed position. Further rotation beyond the "OFF" position of the knob 162 is prevented by engagement of the abutment member 174 with the end of the groove 176 in the housing plate 14.

It will now therefore be seen that the improved manual main shutoff valve of the present invention provides a simple, sturdy construction which is reliable in operation. The valve will not leak if accidentally subjected to excessive inlet pressure or abnormally high temperature conditions.

While there has been described above the principles of this invention in connection with a specific valve construction, it is to be understood that this description is made only by way of example and not as a limitation to the scope of the invention.

What is claimed is:

1. In a combination control for a gas burner comprising a casing having an inlet, an outlet and a flow passage disposed between said inlet and said outlet; and further comprising a manual main shutoff valve, a thermostatic valve and a diaphragm valve located in said casing and serially connected in said flow passage for controlling as flow between said inlet and said outlet; an improved manual main shutoff valve construction comprising:

a partition plate defining part of said casing and having an annular valve seat portion located in said flow passage;

a valve member disposed in said flow passage; said valve member having an open position and having a closed position seated on said valve seat portion;

a valve operating stem axially movable within said casing and connected at one end to said valve member;

a spring acting upon the opposite end of said stem for biasing said valve member toward said valve seat portion;

a housing plate positioned in overlying relation to said partition plate;

a valve actuator rotatably carried on said housing plate and including a knob for manual rotation of said actuator between off and on positions;

a cam fixed to said actuator and having a cam surface consisting of a raised portion, a lower portion and an inclined portion connecting said raised portion to said lower portion; and an operating lever pivotally mounted in said casing between said partition plate and said housing plate; said lever having an operating end operatively connected to said opposite end of said stem; said lever including a cam follower riding on said cam surface of said cam to effect pivotal movement of said operating end upon rotation of said actuator between said off and on positions; said cam follower being in engagement with said lower portion and said raised portion, respectively, of said cam surface when said actuator is in its off and on positions and riding on said inclined portion of said cam surface upon movement of said actuator between its off and on positions; said operating end of said lever being operatively connected to said opposite end of said stem to move said valve member to its open position when said actuator is rotated to its on position and to permit said spring to bias said valve member to its closed position when said actuator is rotated to its off position.

2. The manual main shutoff valve construction of claim 1 wherein said partition plate has a wall portion positioned in spaced relation to said valve seat portion; said valve operating stem being slidably mounted in said wall portion; a generally cup-shaped retainer having a sleeve portion and having a radial end wall fixed to said opposite end of said stem; said retainer having an outwardly directed annular flange at the open end of said sleeve portion; said spring being of the coiled compression type and encircling said stem; said spring being compressed between said wall portion and said end wall of said retainer; said operating end of said lever being bifurcated to straddle said sleeve portion of said retainer and to engage said flange for moving said valve member to its open position when said actuator is rotated to its on position.

3. The manual main shutoff valve construction of claim 2 wherein said actuator carries an abutment member; said housing plate having spaced stops thereon cooperable with said abutment member to limit rotational movement of said actuator; said stops being located so as to engage said abutment member when said actuator is in its off and on positions, respectively; said raised portion of said cam surface including a drop-off section engageable with said cam follower of said lever when said abutment member engages one of said stops in the on position of said actuator for releasably holding said actuator in the on position thereof.

* * * * *